US010246163B2

(12) United States Patent
Erskine et al.

(10) Patent No.: US 10,246,163 B2
(45) Date of Patent: Apr. 2, 2019

(54) BOAT WINDSHIELD WITH SLIDING WALK-THROUGH DOOR

(71) Applicant: Taylor Made Group, LLC, Gloversville, NY (US)

(72) Inventors: Edward J. Erskine, Benson, NY (US); Michael Trajlinek, Johnstown, NY (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 15/667,719

(22) Filed: Aug. 3, 2017

(65) Prior Publication Data

US 2019/0039690 A1 Feb. 7, 2019

(51) Int. Cl.

| | |
|---|---|
| ***B63B 19/02*** | (2006.01) |
| ***B63B 17/02*** | (2006.01) |
| ***B63B 17/00*** | (2006.01) |
| ***B63B 19/00*** | (2006.01) |

(52) U.S. Cl.

CPC ..... *B63B 19/02* (2013.01); *B63B 17/00* (2013.01); *B63B 17/02* (2013.01); *B63B 19/00* (2013.01)

(58) Field of Classification Search

CPC ..... B63B 17/00; B63B 17/02; B63B 19/00; B63B 19/02

USPC ..... 114/361; 296/96.11, 96.12, 96.13

See application file for complete search history.

(56) References Cited

U.S. PATENT DOCUMENTS

| | | | | |
|---|---|---|---|---|
| 2,089,458 | A | 8/1937 | Westenfelder | |
| 3,414,039 | A | 12/1968 | King | |
| 3,438,073 | A | 4/1969 | Brown | |
| 4,970,946 | A | 11/1990 | Ivey | |
| 5,309,860 | A * | 5/1994 | Shearer | E05D 5/10 114/361 |
| 5,640,924 | A * | 6/1997 | Murrant | B63B 17/02 114/361 |
| 5,709,163 | A | 1/1998 | Livingston | |
| 5,797,791 | A | 8/1998 | Humphrey et al. | |
| 7,464,660 | B2 * | 12/2008 | Erskine | B63B 17/02 114/361 |
| 2008/0173229 | A1 * | 7/2008 | Malcore | B63B 17/02 114/361 |

* cited by examiner

*Primary Examiner* — Lars A Olson
(74) *Attorney, Agent, or Firm* — Nixon & Vanderhye P.C.

(57) ABSTRACT

A boat windshield with a walk-through door includes a fixed panel framework attachable to a boat and a sliding door panel coupled to and cooperable with the fixed panel framework. The sliding door panel is displaceable between an open position and a closed position. The sliding door panel is provided with top and bottom traveler cars mounted for displacement on tracks secured to the fixed panel framework frame. A roller post may be positioned adjacent a bottom edge of the fixed panel framework that supports the sliding door panel during displacement between the open and closed positions.

17 Claims, 7 Drawing Sheets

BOAT WINDSHIELD WITH SLIDING WALK-THROUGH DOOR

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND

The invention relates to a boat windshield and, more particularly, to a boat windshield including a sliding walk-through the door.

Many existing boat designs include a door or opening in a windshield to enable passengers to pass between the helm and the bow of the boat. Existing designs typically include a door or openable member secured on a hinge so that a portion of the windshield can be pivoted to an open position to enable passage through the windshield. Hinging, however, becomes an issue as the boat and the door/windshield get larger. The hinged portion can get very heavy and cumbersome. Additionally, the hinged portion tends to have a problem hitting the front brow of the roof when swung open. As a consequence, existing designs are often shorter than desired. Still further, with a curved hinged portion/door, when the door is opened, the curvature of the door is opposite to the curvature of the windshield, and as a result, the open door occupies too much space and looks awkward.

BRIEF SUMMARY

According to the described embodiments, a boat windshield is provided with a sliding walk-through door that overcomes the drawbacks noted above with regard to existing designs. A sliding door panel is displaceable in a door frame between open and closed positions. The system can accommodate either a walk through style where the bow area floor is similar in height to the cabin floor or a step up and over style when the bow area is raised above the forward cabin.

In an exemplary embodiment, a boat windshield with a walk-through door includes a door frame attachable to a boat, the door frame including a panel side member and a door side member. A fixed door panel is secured in the door frame and includes a framework having a top member extending between and connecting the panel side member and the door side member, an inside member, and a bottom member extending from the panel side member to the inside member. A sliding door panel is displaceable between an open position at least partly overlaying the fixed door panel and a closed position.

The windshield may further include a top track disposed on the top member, a bottom track disposed on the bottom member, at least one top traveler coupled with the sliding door panel and engaging the top track, and at least one bottom traveler coupled with the sliding door panel and engaging the bottom track. A roller post may be fixed to the inside member and positioned adjacent a distal end of the bottom member, where the roller post supports the sliding door panel. A support position of the roller post may be adjustable. In some embodiments, the roller post comprises a channel member positioned fixed to the inside member and a post member disposed in the channel member, where a position of the post member relative to the channel member is adjustable to adjust the support position of the roller post. The roller post may further include a roller that is coupled with the post member. The post member may be locked in the support position by a lock screw extending through the channel member into engagement with the post member.

One of the bottom travelers may be positioned laterally outside of the sliding door panel.

A door latch may be secured to a distal end of the sliding door panel that is selectively engageable with a corresponding receiver positioned in the door side member.

In another exemplary embodiment, a boat windshield with a walk-through door includes a door frame attachable to a boat, a fixed door panel secured in the door frame, and a sliding door panel secured in the door frame and displaceable between an open position and a closed position. A top track and a bottom track are coupled with the door frame. A top traveler is coupled with the sliding door panel and engages the top track, and a bottom traveler is coupled with the sliding door panel and engages the bottom track. A roller post positioned adjacent a bottom edge of the fixed door panel supports the sliding door panel.

In yet another exemplary embodiment, a boat windshield with a walk-through door includes a fixed panel framework attachable to a boat, and a sliding door panel coupled to and cooperable with the fixed panel framework and displaceable between an open position and a closed position. The sliding door panel includes top and bottom travelers mounted for displacement on tracks secured to the fixed panel framework. A roller post positioned adjacent a bottom edge of the fixed panel framework supports the sliding door panel during displacement between the open and closed positions.

BRIEF DESCRIPTION OF THE DRAWINGS

These and other aspects and advantages will be described in detail with reference to the accompanying drawings, in which.

DETAILED DESCRIPTION

Figure 1:
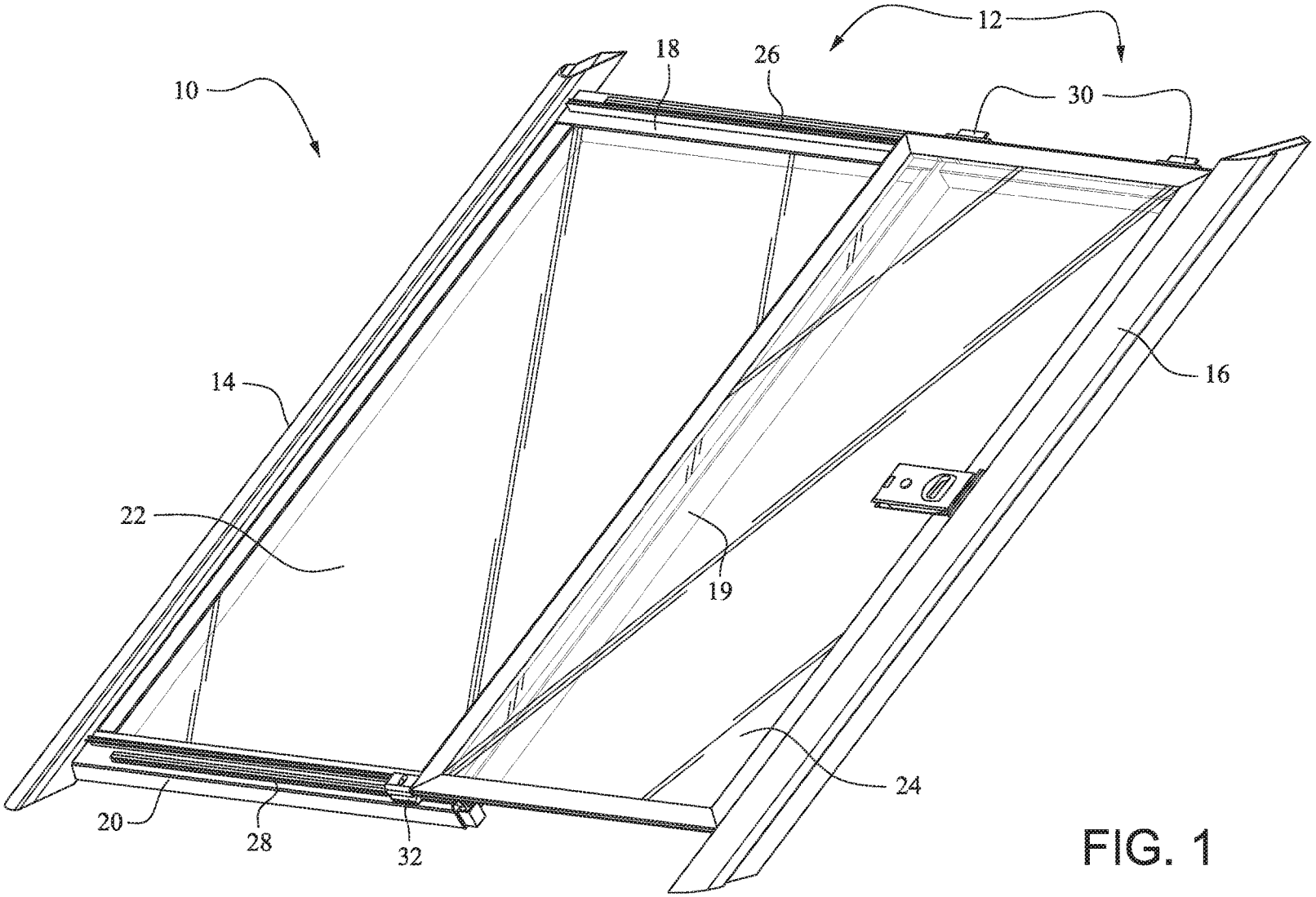
FIGS. 1 and 2 are perspective views of the windshield in closed and open positions, respectively.
Figure 1A:
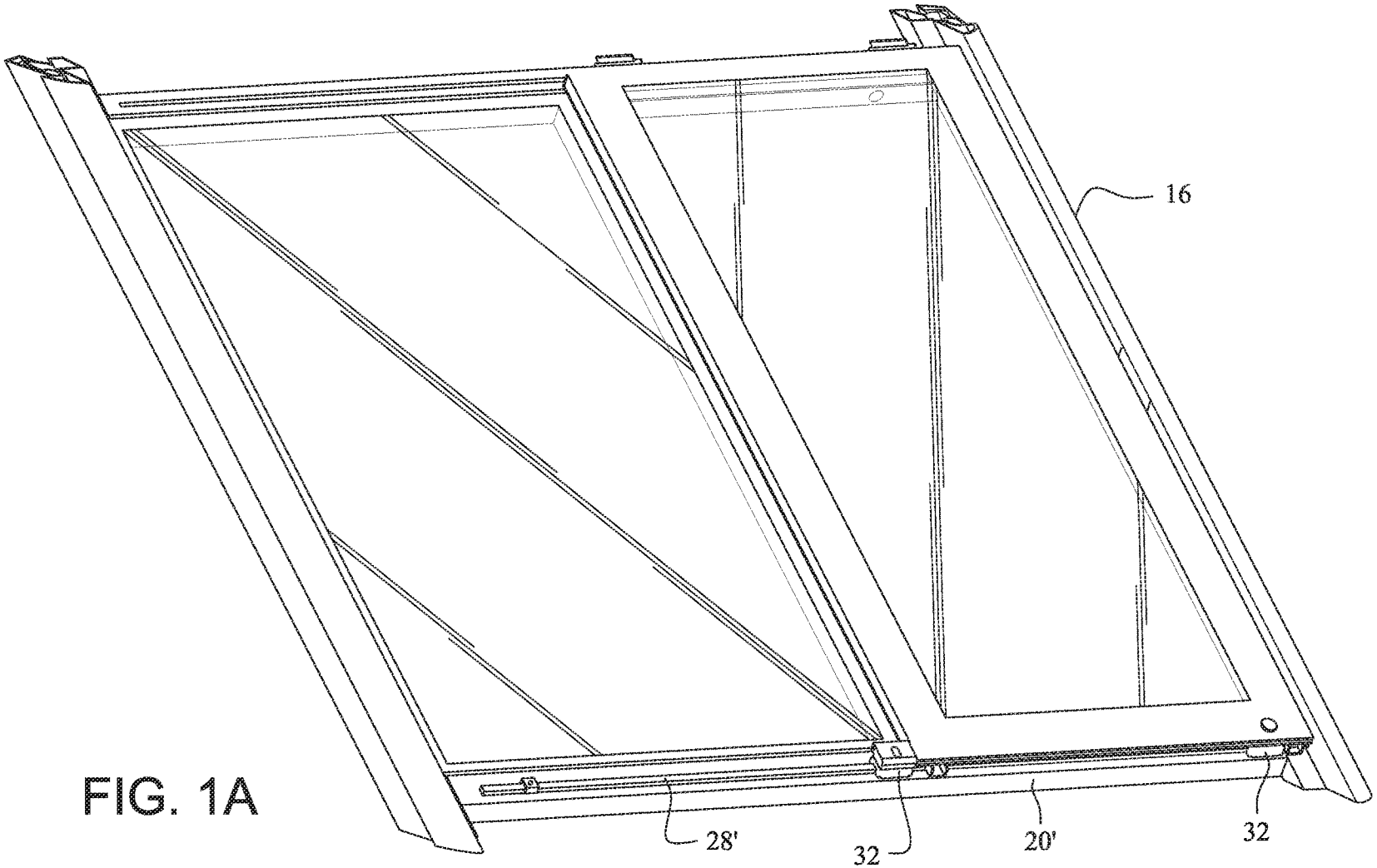
FIG. 1A shows an alternative construction including an extended bottom member.
Figure 2:
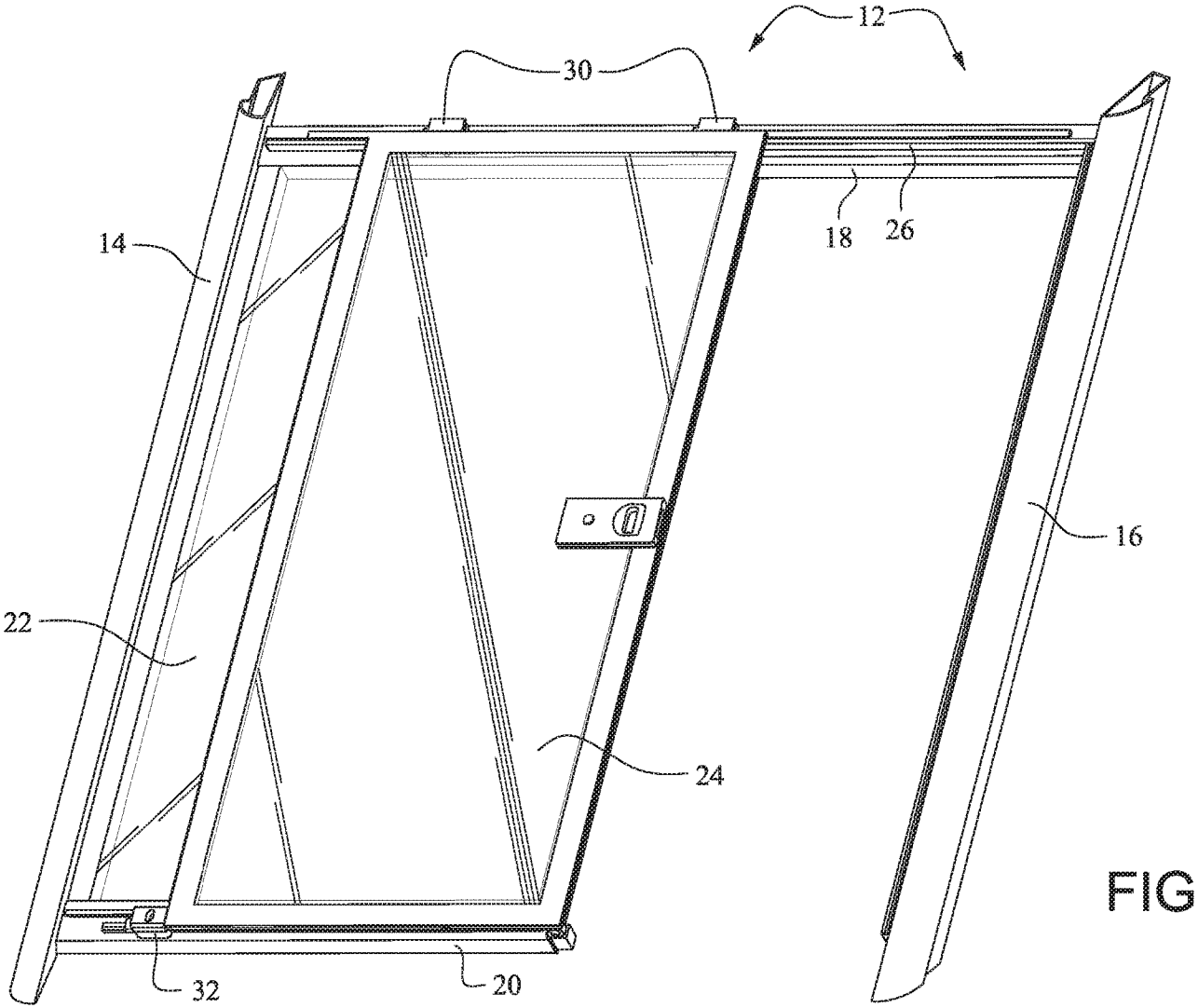

With reference to FIGS. 1 and 2, a boat windshield 10 is shown with a walk-through door. The boat windshield 10 includes a door frame 12 attachable to a boat and including a panel side member 14 and a door side member 16. At least one fixed door panel 22 is secured in the door frame 12. The fixed door panel 22 preferably includes framework supporting a glass window. The framework of the fixed door panel 22 shown in FIG. 1 includes a top member 18 that extends from the panel side member 14 to an inside member 19 and from the inside member 19 to the door side member 16. The framework of the fixed door panel 22 also includes a bottom member 20 that extends between the panel side member 14 and the inside member 19. The space at the bottom of the assembly between the inside member 19 and the door side member 16 may be open. Alternatively, as shown in FIG. 1A, an extended bottom member 20' may connect the inside member 19 and the door side member 16 for added structural support.

A sliding door panel 24 is displaceable between an open position at least partly overlaying the fixed door panel 22 (see FIG. 2) and a closed position adjacent the door side member 16 (see FIG. 1). The inside member 19 is essentially parallel with a distal end/edge of the sliding door panel 24. In some embodiments, the assembly may include two fixed door panels 22 on opposite sides of the sliding door panel 24, in which case the assembly may include a second inside member 19.

Figure 5:
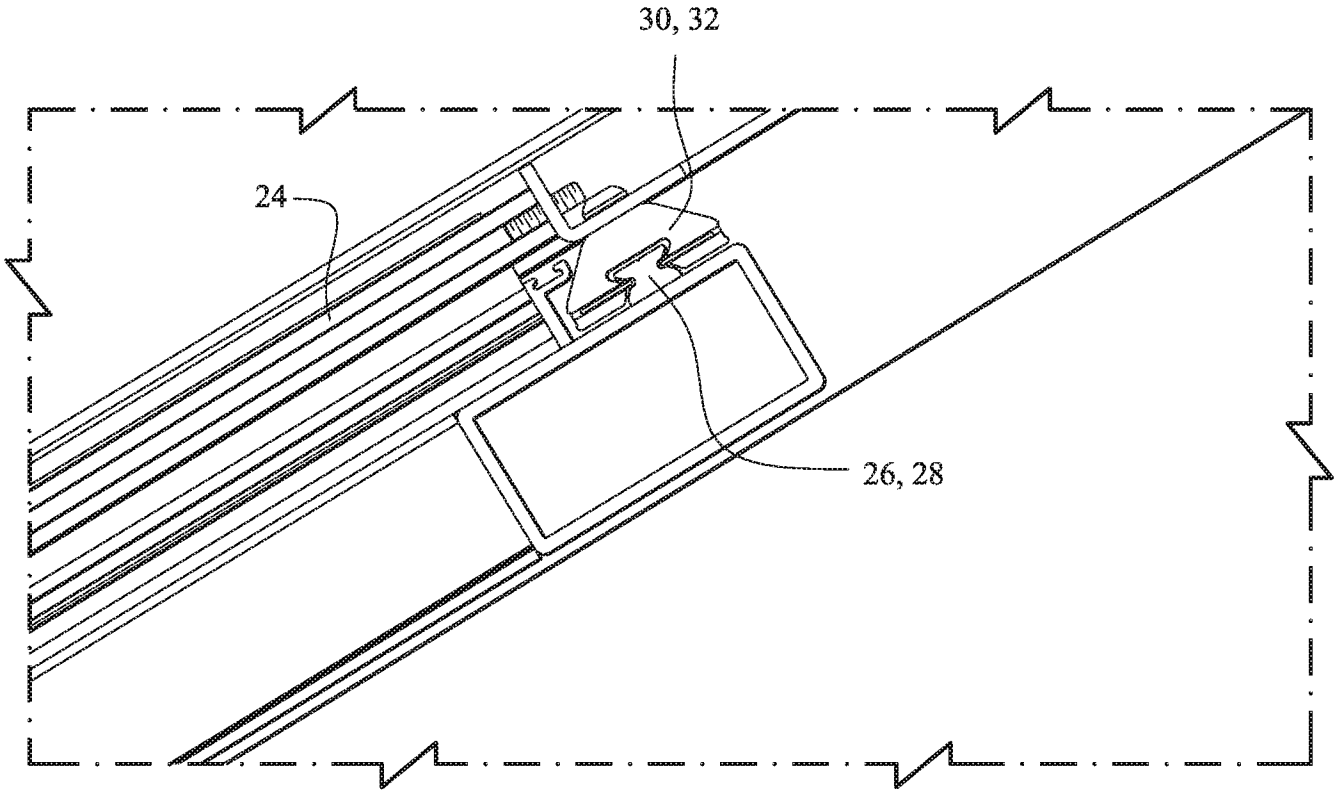
FIG. 5 is an end view of the assembly showing details of the track and traveler.

With continued reference to FIGS. 1 and 2, a top track 26 is positioned on the top member 18, and a bottom track 28 is positioned on the bottom member 20. At least one top traveler or bearing car 30 is secured to the sliding door panel 24 and engages the top track 26. In a preferred construction, as shown in FIGS. 1 and 2, the assembly may include two top travelers 30. At least one bottom traveler or bearing car 32 is secured to the sliding door panel 24 and engages the bottom track 28. The top travelers 30 control the movement of the sliding door panel 24 and hold the sliding door panel 24 securely. The top travelers 30 may be swivel mounted to allow for angle changes as the door panel 24 slides open along a curved path. The sliding door panel 24 may also be adjustable relative to the top travelers 30 to permit adjustments for alignment. The tracks 26, 28 and travelers 30, 32 may be of any suitable construction. An exemplary traveler is a Harken car and associated track (see FIG. 5). In the embodiment shown in FIG. 1A, the extended bottom member 20' may be provided with an extended bottom track 28', in which case the assembly would include at least a second bottom traveler 32.

Figure 3:
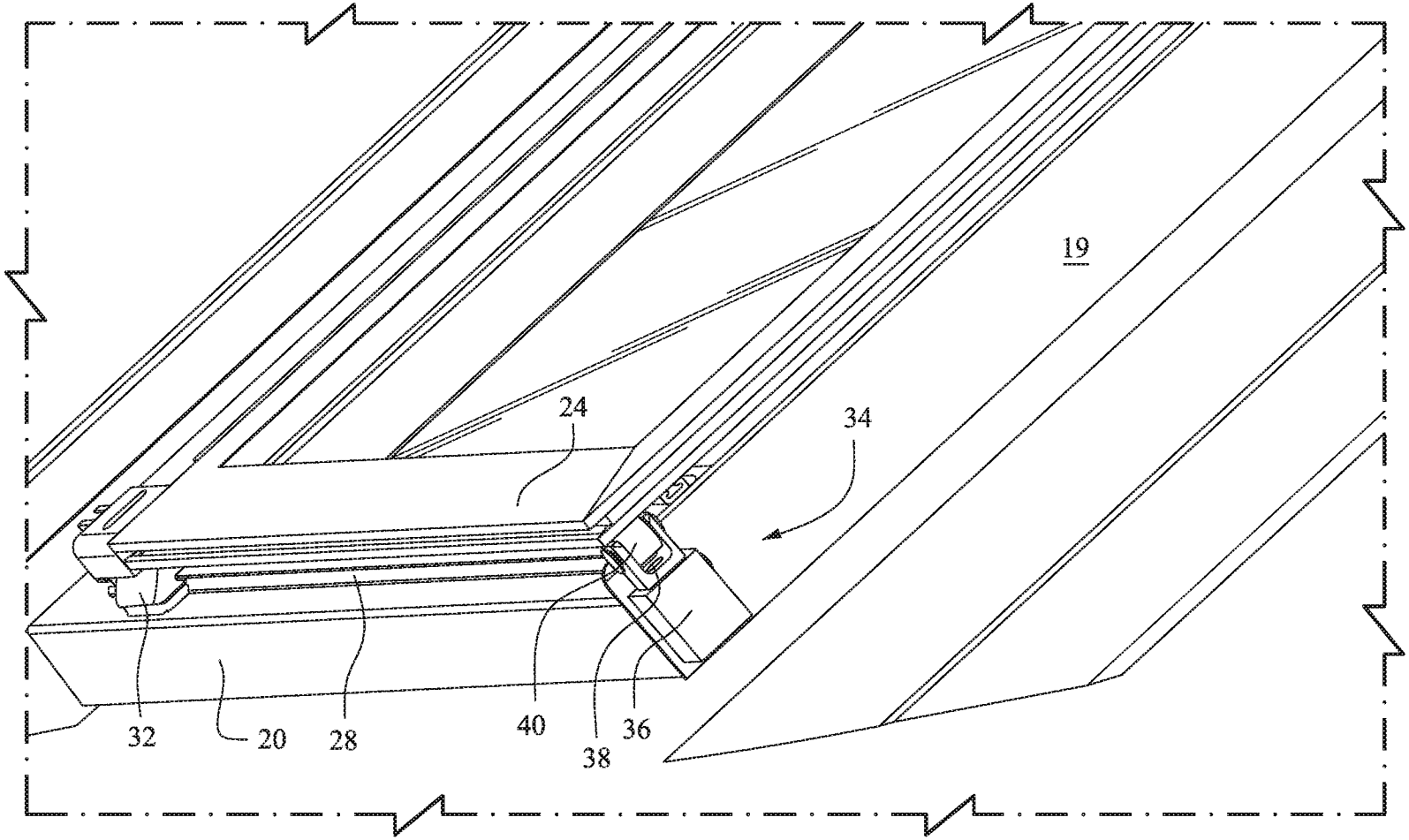
FIG. 3 is a detailed perspective view of a bottom portion of the windshield assembly.
Figure 4:
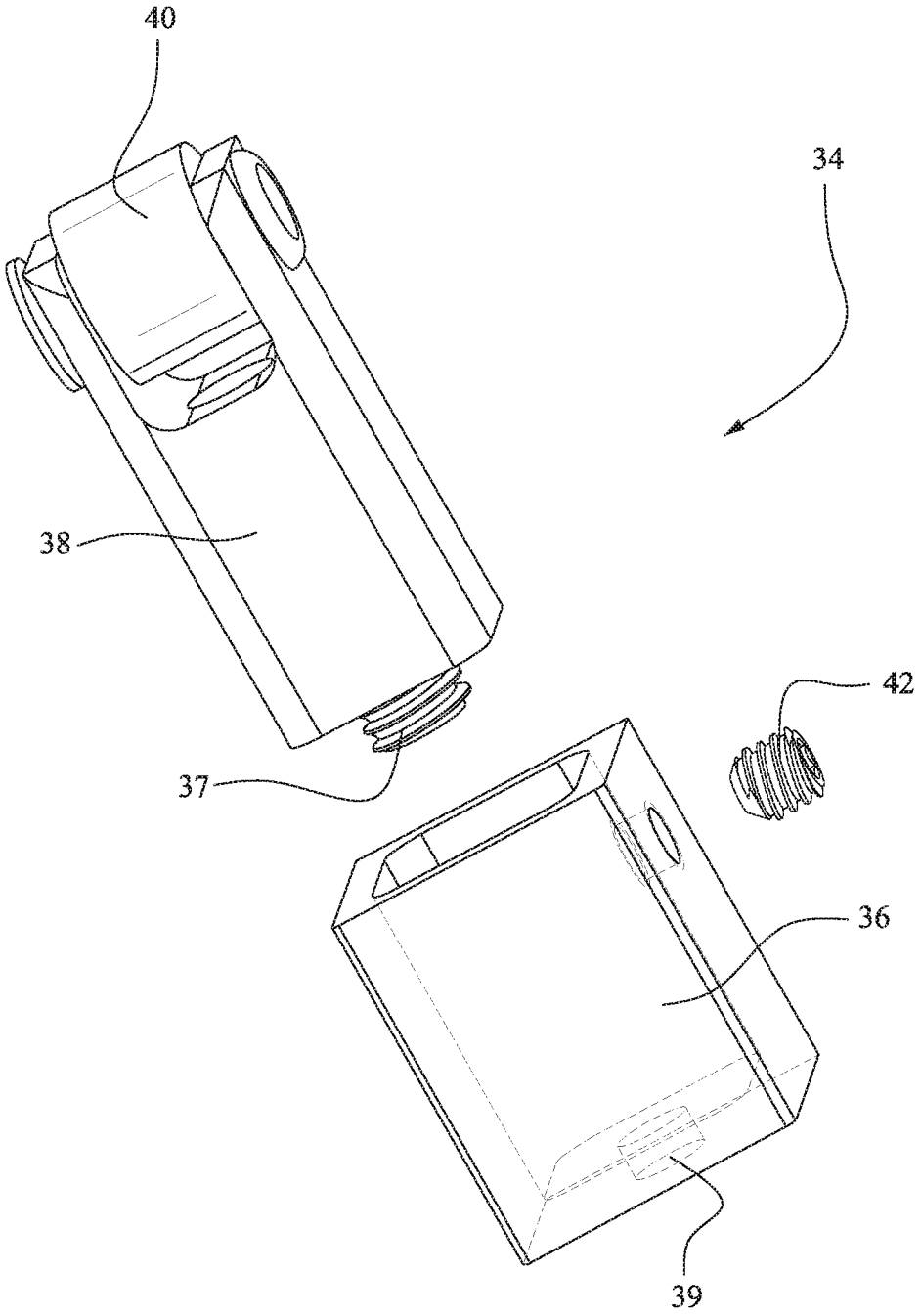
FIG. 4 is a detailed view of a roller post that supports the sliding door panel.

With reference to FIG. 3, the assembly may additionally include a roller post 34 fixed to the inside member 19 and positioned adjacent a distal end of the bottom member 20. As shown, the roller post 34 supports the sliding door panel 24 during displacement between the open and closed positions. The roller post 34 counteracts the tendency of the sliding door panel 24 to sag as it crosses the open space. As shown in FIG. 4, in some embodiments, the roller post 34 may include a channel member 36 fixed to the inside member 19 and positioned adjacent the distal end of the bottom member 20 and a post member 38 disposed in the channel member 36. A position of the post member 38 relative to the channel member 36 may be adjustable via an adjuster screw 37 accessible through an opening 39 in the channel member 36 to adjust the support position of the roller post 34. The roller post 34 may also include a roller 40 that is coupled with the post member 38. The post member 38 is preferably locked in the support position by a lock screw 42 that extends through the channel member 36 into engagement with the post member 38.

Figure 6:
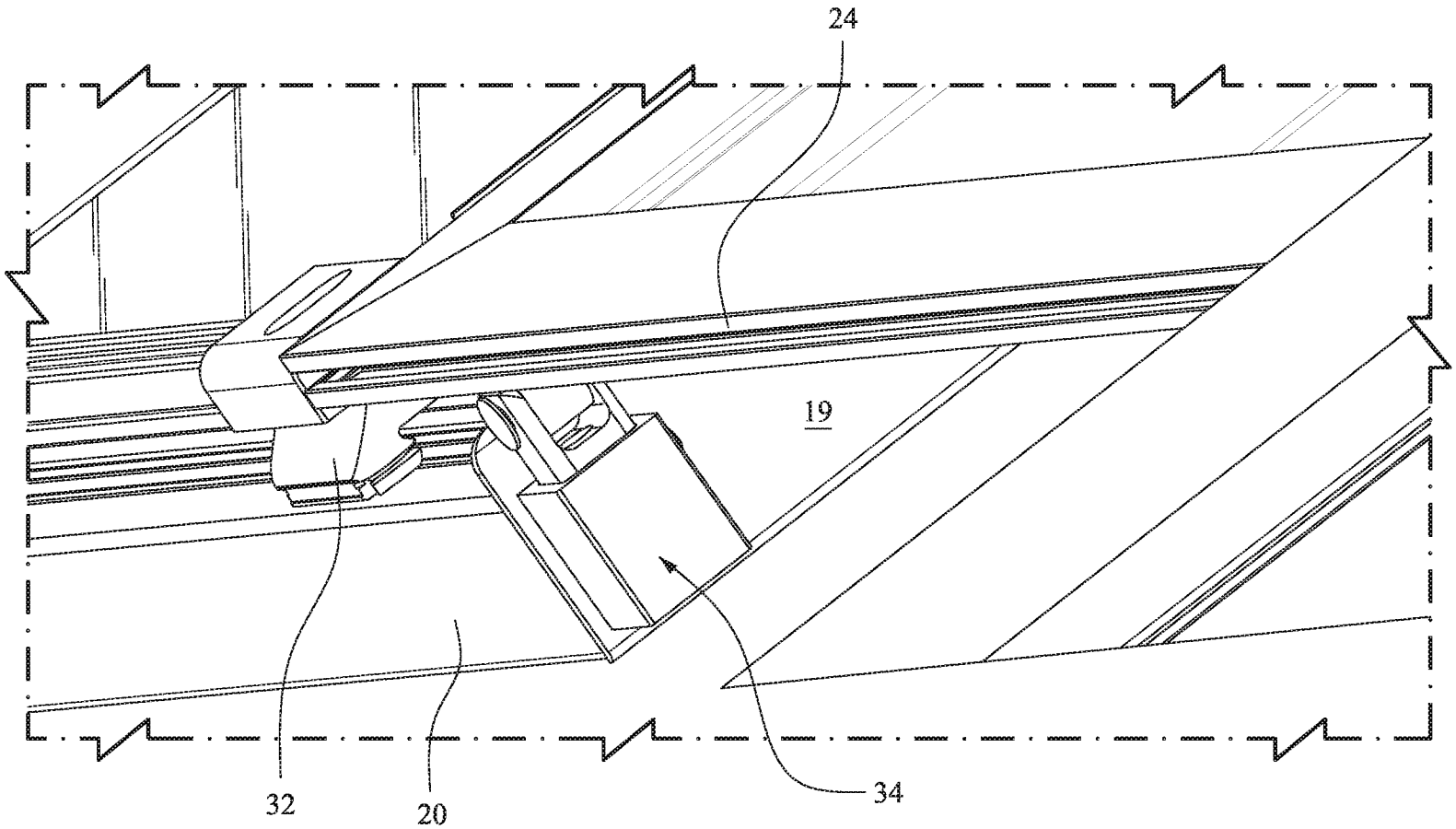
FIG. 6 is a bottom view of the assembly showing a position of the bottom traveler car relative to the door panel.

As shown in FIGS. 1, 2 and 6, one of the bottom travelers 32 may be positioned laterally outside of the sliding door panel 24. The position shown accommodates differences in width between the sliding door panel 24 and the door opening and provides greater leverage over the roller post 34. The position of the outside traveler also provides room for drainage and provides access to the bottom traveler for service or replacement if necessary.

The bottom traveler 32 takes the upward force created by the sliding door panel 24 balancing on the roller post 34. There may be a slotted attachment from the sliding door panel 24 to the travelers to take up the geometric difference in the arc of the traveler movement between the top and bottom travelers caused by the curvature of the windshield and the angle that the windshield lays back on the boat.

The assembly can be configured as shown such that the sliding door panel 24 may be provided on the port side and slide to center. Alternatively, the door panel may be secured in the center and slide to port or starboard. The configuration depends on where the driving station is and the interior arrangement of access to the forward cabin and bow.

The assembly may also include a door latch 44 secured to a distal end of the sliding door panel 24 and selectively engageable with a corresponding receiver 46 positioned in the door side member 16.

By providing a sliding walk-through door in a boat windshield, problems associated with existing pivoted doors can be overcome. The assembly including a sliding door panel rather than a pivoting or hinged door provides for a cleaner appearance when open and can better accommodate larger boats with larger windshields.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A boat windshield with a walk-through door, comprising:

a door frame attachable to a boat, the door frame including a panel side member and a door side member;

a fixed door panel secured in the door frame, the fixed door panel including a framework having a top member extending between and connecting the panel side member and the door side member, an inside member, and a bottom member extending from the panel side member to the inside member; and a sliding door panel directly engaging the framework of the fixed door panel and displaceable laterally across the top member of the framework relative to the panel side member and the door side member between an open position at least partly overlaying the fixed door panel and a closed position.

2. A boat windshield according to claim 1, further comprising:

a top track disposed on the top member;

a bottom track disposed on the bottom member;

at least one top traveler coupled with the sliding door panel and engaging the top track; and at least one bottom traveler coupled with the sliding door panel and engaging the bottom track.

3. A boat windshield according to claim 2, further comprising a roller post fixed to the inside member and positioned adjacent a distal end of the bottom member, the roller post supporting the sliding door panel.

4. A boat windshield according to claim 3, wherein a support position of the roller post is adjustable.

5. A boat windshield according to claim 4, wherein the roller post comprises a channel member fixed to the inside member and a post member disposed in the channel member, wherein a position of the post member relative to the channel member is adjustable to adjust the support position of the roller post.

6. A boat windshield according to claim 5, wherein the roller post further comprises a roller that is coupled with the post member.

7. A boat windshield according to claim 5, wherein the post member is locked in the support position by a lock screw extending through the channel member into engagement with the post member.

8. A boat windshield according to claim 2, wherein one of the at least one bottom traveler is positioned laterally outside of the sliding door panel.

9. A boat windshield according to claim 1, further comprising a door latch secured to a distal end of the sliding door panel and selectively engageable with a corresponding receiver positioned in the door side member.

10. A boat windshield with a walk-through door, comprising:

a door frame attachable to a boat;

a fixed door panel secured in the door frame;

a sliding door panel secured in the door frame and displaceable between an open position and a closed position;

a top track and a bottom track coupled with the fixed door panel;

a top traveler coupled with the sliding door panel and engaging the top track;

a bottom traveler coupled with the sliding door panel and engaging the bottom track; and a roller post positioned adjacent a bottom edge of the fixed door panel, the roller post supporting the sliding door panel.

11. A boat windshield according to claim 10, wherein a support position of the roller post is adjustable.

12. A boat windshield according to claim 11, wherein the roller post comprises a channel member positioned adjacent the bottom edge of the fixed door panel and a post member disposed in the channel member, wherein a position of the post member relative to the channel member is adjustable to adjust the support position of the roller post.

13. A boat windshield according to claim 12, wherein the roller post further comprises a roller that is coupled with the post member.

14. A boat windshield according to claim 12, wherein the post member is locked in the support position by a lock screw extending through the channel member into engagement with the post member.

15. A boat windshield with a walk-through door, comprising:

a fixed panel framework attachable to a boat;

a sliding door panel coupled to and cooperable with the fixed panel framework and displaceable between an open position and a closed position, the sliding door panel including top and bottom travelers mounted for displacement on tracks secured to the fixed panel framework; and a roller post positioned adjacent a bottom edge of the fixed panel framework and supporting the sliding door panel during displacement between the open and closed positions.

16. A boat windshield with a walk-through door, comprising:

a fixed panel framework attachable to a boat;

a sliding door panel coupled to and cooperable with the fixed panel framework and displaceable between an open position and a closed position, the sliding door panel including top and bottom travelers mounted for displacement on tracks secured to the fixed panel framework; and a roller post positioned adjacent an edge of the fixed panel framework and supporting the sliding door panel during displacement between the open and closed positions.

17. A boat windshield with a walk-through door, comprising:

a door frame attachable to a boat, the door frame including a panel side member and a door side member;

a fixed door panel secured in the door frame, the fixed door panel including a framework having a first member extending between and connecting the panel side member and the door side member, an inside member, and a second member extending from the panel side member to the inside member; and a sliding door panel coupled with the framework of the fixed door panel and displaceable laterally across the first member of the framework relative to the panel side member and the door side member between an open position at least partly overlaying the fixed door panel and a closed position.

* * * * *